United States Patent [19]

Goessler

[11] 4,311,899

[45] Jan. 19, 1982

[54] COOKING APPARATUS

[75] Inventor: Gerhard Goessler, Oberderdingen, Fed. Rep. of Germany

[73] Assignee: E.G.O. Elektro-Gerate, Blanc und Fischer, Fed. Rep. of Germany

[21] Appl. No.: 141,870

[22] Filed: Apr. 21, 1980

Related U.S. Application Data

[63] Continuation of Ser. No. 961,837, Nov. 17, 1978, abandoned.

[51] Int. Cl.[3] ..... H05B 3/72

[52] U.S. Cl. ..... 219/461; 219/464; 219/347; 219/354

[58] Field of Search ..... 219/460–463, 219/457–459, 455, 443

[56] References Cited

U.S. PATENT DOCUMENTS

| | | | |
|---|---|---|---|
| 1,515,308 | 11/1924 | Maul | 219/455 |
| 1,706,016 | 3/1929 | Wiegand | 219/459 |
| 2,299,596 | 10/1942 | Rycroft | 219/455 |
| 2,361,874 | 10/1944 | Russell | 219/461 |

*Primary Examiner*—B. A. Reynolds
*Assistant Examiner*—Bernard Roskoski
*Attorney, Agent, or Firm*—Steele, Gould & Fried

[57] ABSTRACT

A cooking unit comprises a substantially flat, thin-walled plate provided with helical grooves. Heating elements in the form of helical, flattened, tubular bodies are received in the grooves and provide a heating surface in which cooking vessels can stand.

25 Claims, 6 Drawing Figures

COOKING APPARATUS

This is a continuation, of application Ser. No. 961,837, filed Nov. 17, 1978, now abandoned.

FIELD OF THE INVENTION

The invention relates to a cooking apparatus with a cooking surface formed by flattened tubular heating bodies, on which cooking vessels can stand and in which the tubular heating bodies rest on a support and are arranged above a closed surface.

BACKGROUND OF THE INVENTION

Cooker plates of this type, for example as described in German Pat. No. 1,189,217, have a relatively small thermal capacity and are therefore quite suitable for rapid initial cooking procedures when small amounts of product are to be cooked.

They do however have the substantial drawback that they do not form a closed cooking surface so that if material which is being cooked overflows, it can run past them into the interior of the cooker whence it can be removed later on only with difficulty. The entire cooker surface is therefore made to be pivotal so that the interior of the cooker can be cleaned. The cooker unit has a dish which collects the material which has overflowed. This dish lies at a substantial distance below the spirally wound tubular heating bodies. Moreover, these known tubular cooker plates have the disadvantage that their temperature can be controlled only poorly.

A cooker unit is also known from U.S. Pat. No. 1,979,471, in which the cooking surface is formed by a ceramic plate with deep spiral grooves which are open at the top and in which lie heating coils. A radiant heating means is thus formed since the ceramic plate transfers the heat only poorly. In this case, cooking material which has overflowed is particularly unpleasant because it runs directly on to the open heating elements and sticks to them or short-circuits them under certain circumstances. Moreover, heating elements of this type in the form of open resistance wires are objectionable for safety reasons.

BRIEF SUMMARY OF THE INVENTION

An object of the present invention is to provide a cooker unit with a cooking surface formed by tubular heating bodies, which is superior to known cooker units, in particular with respect to the ability to keep it clean.

According to the invention there is provided a cooking apparatus comprising a substantially flat, thin-walled plate provided with grooves, and forming a closed surface, and flattened tubular heating bodies arranged in the grooves and forming a cooking surface for receiving cooking vessels.

The apparatus according to the invention has the advantage over conventional tubular cooker plates in that it has a substantially closed cooking surface beyond which the tubular heating bodies need project only slightly.

The tubular heating bodies can penetrate the thin-walled plate in a sealed manner so that there is no fear of cooking material running through in a downward direction. Although the tubular heating bodies lie partially in the grooves, sufficient lies beyond them for them to form the cooking surface. The plate reaches high temperatures very rapidly owing to its thinness, forms an additional reflecting and radiating surface, and allows food which overflows and which collects in the grooves to be baked into fine ash which can be removed, for example, by being blown or brushed out. The cooker plate is thus preferably self-cleaning.

In order to keep the transfer of heat by contact between the flat thin-walled plate and the tubular heating bodies relatively low, the tubular heating bodies can be supported by support projections lying at a distance from each other and arranged in the grooves. The projections are preferably formed by stampings on the base of the grooves.

The generally flat, thin-walled plate, which is preferably produced from stainless steel, can withstand the considerable thermal and mechanical stresses caused by thermal expansion particularly well if the grooves are arranged spirally to correspond to the tubular heating bodies contained in them and impart to the plate a radial elasticity for taking up the thermal stresses. In this arrangement, the plate works as a diaphragm with corrugated profiling.

The thin diaphragm-like plate is preferably borne by an internal support which can lie, for example, in a substantially closed trough of the cooker plate. The cooker plate thus needs to have only relatively small openings and this increases its stability. Good insulating material can also be inserted there, and this increases efficiency and keeps thermal load on the cooker or on items of kitchen furniture lying beneath a fitted cooker trough, even in the case of a very small structural height. As the diaphragm-like plate with the tubular heating body arranged on it forms a thermally substantially coherent but tight unit, it is also possible to arrange temperature monitoring instruments, for example temperature limiters, beneath the plate without their temperature sensors being exposed to dirt or damage. The above-mentioned small structural height should be mentioned because there is no need for a collecting dish for food which has overflowed, with a throw-away foil which can be optionally inserted.

An embodiment of the invention is shown in the accompanying drawings.

DETAILED DESCRIPTION OF PREFERRED EMBODIMENT

Figure 1:
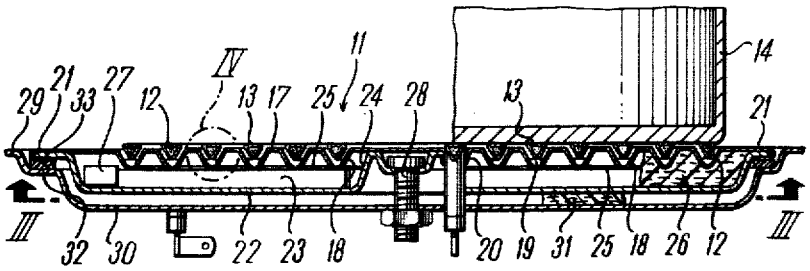
FIG. 1 shows a cross-section through a cooker unit according to the invention.
Figure 2:
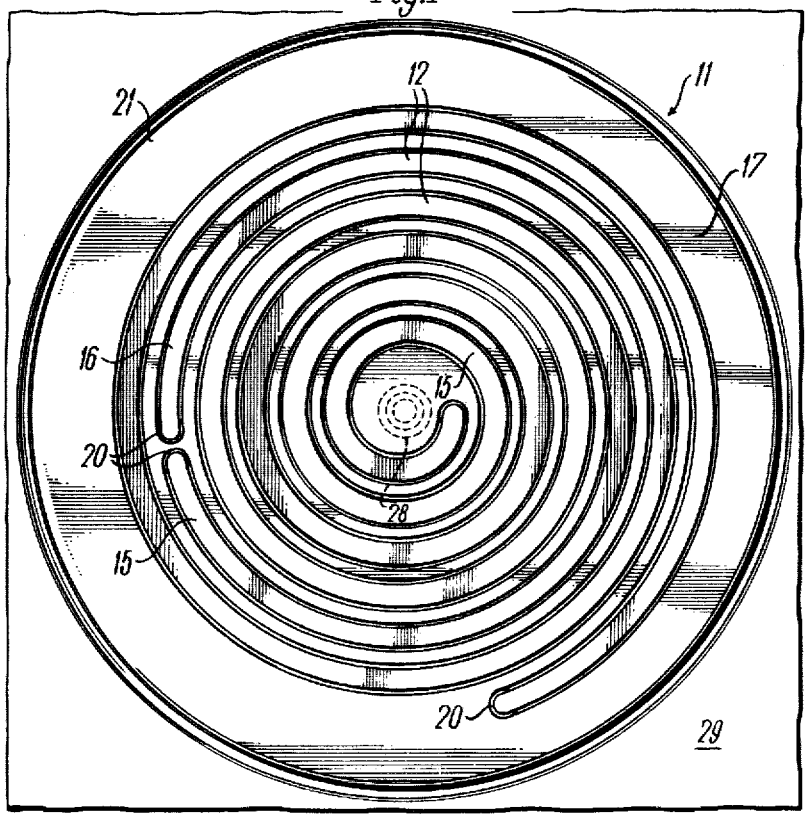
FIG. 2 shows a plan view of the cooker unit according to FIG. 1.

The cooker unit 11 illustrated in the drawings has tubular heating bodies 12 which have a substantially triangular cross-section which is flattened on their upper side. The upper flattened side forms the cooking surface 13 on which cooking vessels 14 can stand. The tubular heating bodies 12 form two heating resistances which are wound spirally. An internal heating resistance 15 is surrounded by an external heating resistance 16, the internal end of the heating resistance 16 being connected directly to the external end of the heating resistance 15. The heating resistance 15 thus forms a central heating zone while the heating resistance 16 forms an external heating ring.

The tubular heating bodies have relatively small cross-sectional dimensions, the largest dimension of which (a triangular side) amounts to about 5 mm, and are therefore quite flexible and are well adapted to the heated surface of the cooking vessel 14. They can be made of a rust-resistant metallic casing and substantially coil-shaped heating conductors in an insulating embedding composition embedded therein. Owing to the triangular shaping, the cross-section of the coil is also approximately triangular.

The tubular heating bodies lie on a thin plate 17 which is made of very thin stainless steel plate with thicknesses of the order of 0.2 to 0.4 mm. Spiral grooves 18 having a substantially triangular cross-sectional shape (with rounded corners) are shaped into the circular plate 17 to correspond to the spiral shape of the heating resistances 14 and 15. Support projections 19 are arranged on the bottom of these grooves at intervals of a few centimeters. In the illustrated embodiment, eight support projections 19 are provided round the circumference of the grooves, with the exception of the internal spiral windings.

The support projections 19 are formed by the fact that in each case the bottom of each groove is not shaped to the full depth over a distance of a few millimeters.

Figure 4:
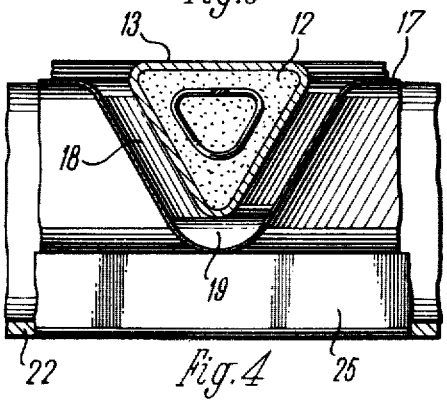
FIG. 4 shows an enlarged cross-section of the detail lying in the dash-dotted circle IV in FIG. 1.
Figure 5:
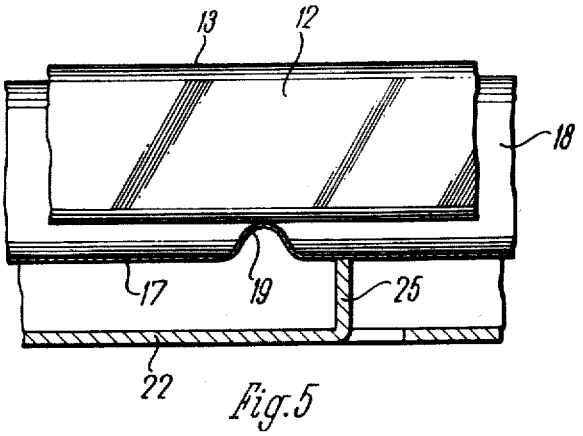
FIG. 5 shows a longitudinal section thereof.

As shown, in particular, in FIG. 4, the lower triangular edge of the tubular heating bodies lies virtually in point contact on the support projection 19 which is also rounded in side view (FIG. 5).

The groove 18 is sufficiently large for the tubular heating body to lie in it at a distance of from 1 to a few millimeters and the cooking surface 13 projects somewhat beyond the flat surface of the plate 17.

The two ends of each heating resistance 15,16 are passed in a sealed manner through openings 20.

In the embodiment illustrated, they are soldered into these openings. A completely sealed cooker unit is thus produced so that overflowing foods cannot run inside the cooker or cooker trough. Although some overflowing food will stick in the grooves and under the tubular heating bodies, this space in the grooves is designed to be such that, having regard to the thinness of the wall of the plate 17 it cleans itself as a result of the carbonisation of the food which has overflowed. A fine ash which can be blown or brushed out is thus formed. The extremely high temperatures which produce this self-cleaning effect are produced only when there is dirt in these positions. If the blank metal surface is exposed, the groove acts as a reflector which irradiates the heat radiation originating from the underside of the tubular heating body upward toward the bottom of the cooking vessel. The groove can also be designed in other ways so as to obtain specific coefficients of reflection and so as not to fall below desired minimum distances between tubualr heating bodies and plate. Thus, for example, it could also be of substantially semi-circular cross-section in the case of a tubular heating body designed semi-circularly on its underside. The support projections could also have another sequence or design. However, it is preferable to stamp them directly from the material of the plate.

Figure 3:
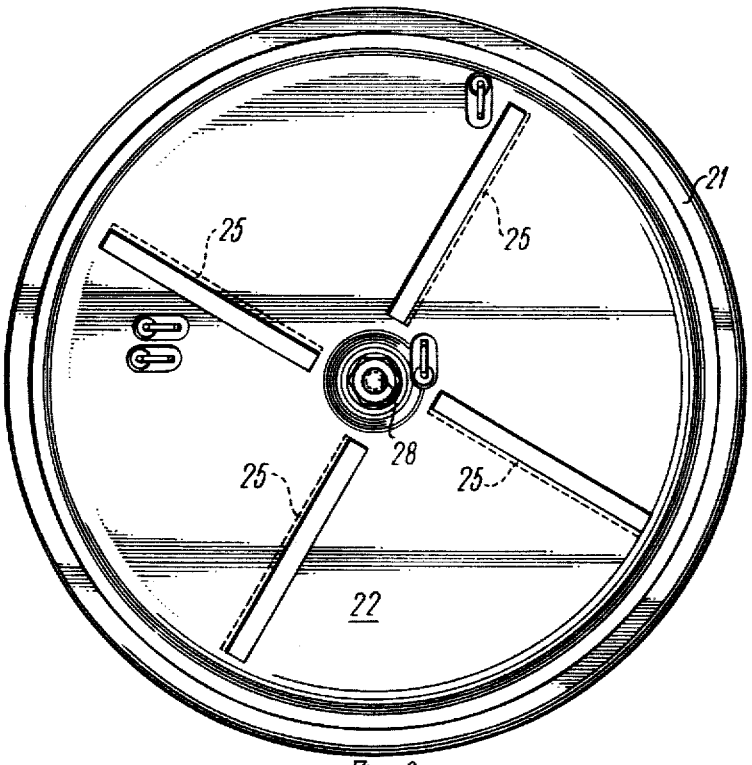
FIG. 3 shows a view along the line III—III in FIG. 1 (view from below a unit)

The plate 17 has a relatively wide unheated edge region 21 between the outermost spiral winding of the heating resistance 16 and its external edge, which ensures that only a very little heat can be conducted toward the edge, owing to the relatively poor heat conducting properties of stainless steel. On the outer circumference, the plate 17 is beaded downward round the external edge 21 of a dish-like disc 22 and thus joined to it. The disc 22 forms a supporting structure for the plate 17. It has a projection 24 directed upwards in its centre so that its recess 23 surrounds the projection 24 in the manner of a groove. The recess 23 in the disc 22 is relatively flat. Support projections 25 are shaped from the disc, which project upwards into its recess 23 and are dimensioned in such a way that the underside of the grooves 18 rest on them. As shown in FIG. 3, the support projections are formed by cutting into the material of the disc and formed upwardly directed flanges which run radially. The plate 17 is borne by the support projections, as well as by the central projection formed by deep stamping of the material of the disc so that even heavy cooking vessels do not produce unacceptable deformation of the plate 17. It should be noted that the plate 17 acquires the properties of a corrugated diaphragm owing to the spiral grooves 18 so that it can compensate even extreme temperature differences without unacceptable deformations. The projection 24 can be welded to the plate 17.

The disc 22 is produced from thicker and more rigid material than the plate 17 and can have a reflecting surface on its interior. It is also possible to insert an insulating material 26 in it (shown in part in FIG. 1).

A temperature limiter 27 can be arranged in the cavity 23 between plate 17 and disc 22, preferably in the edge region, and serves to switch off the cooker unit when an excessive temperature occurs (for example in no-load operation).

A fixing bolt 28 with which the unit 11 can be fixed on a cooker or a cooker trough, is arranged in the region of the central projection 24.

As shown in FIG. 1, the plate 29 in which the unit is fitted can have a relatively flat trough 30 which need be, for example, only 20 to 30 mm deep. This trough 30 can be substantially uninterrupted up to the openings for the ends of the tubular heating body and the central bolt so that the plate 29 has a high inherent stability. Insulating material 31 can be inserted between the trough and the unit 11 lying in it at a small distance (indicated in part in FIG. 1).

On its encircling edge, the trough has an encircling shoulder 32 lying somewhat deepended, on which the edge 21 of the unit 11 is supported with interposition of a sealing ring 33. The unit 11, which is, furthermore, only kept down by the fixing bolt 28 is therefore tightly inserted into the plate 29. The surface of the plate 17 can therefore lie flush with the surface of the plate 29 to form a surface on which saucepans can be slid to and fro without encountering ledges. The small distance between the plate 17 and the heating surface 13 on the tubular heating bodies 12 is thus easily overcome.

It should also particularly be noted that the unit 11 forms a separate unit which can be mounted in advance and produced separately from the rest of the cooker and which can easily be placed on the cooker and exchanged if in need of repair. The total height of the cooker trough can be kept very small owing to the good and multiple means of insulation without the temperature exceeding an allowable value on its underside. Flat incorporation in kitchen furniture is thus possible.

Figure 6:
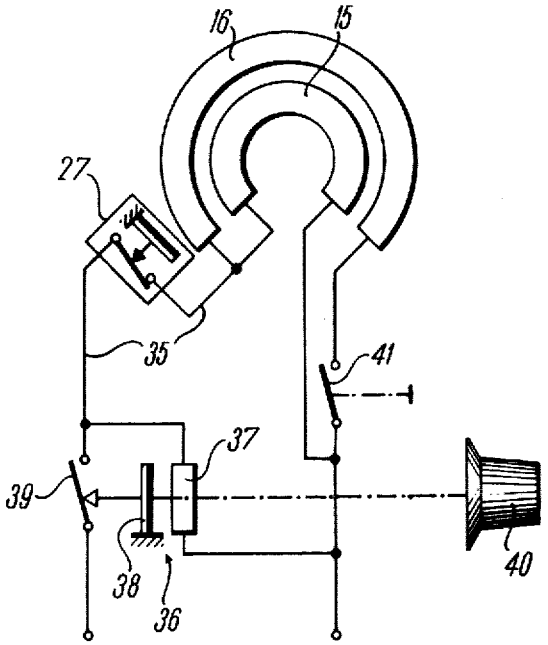
FIG. 6 shows a schematic circuit diagram of the cooker unit.

As shown in FIG. 6, the two heating resistances 15,16 can be switched on separately. The temperature limiter 27 and a power control instrument 36 which usually operates by quantization, lies in a common supply line 35. A bimetallic member 38 heated by a control heating resistance 37 which is connected in parallel with the heating resistances activates a switch 39 of the power control instrument. The power control instrument can be set by means of an actuating button 40. A manually activatable mechanical switch 41 which lies in the supply line to the external heating resistance 16 is also provided. If, for example, the external diameters of the internal heating resistance 15 and the external heating resistance 16 are 140 and 180 mm, housewives can choose whether they wish to use only small or a large heated diameter, depending upon the size of the saucepan used. A very adaptable cooking unit with which energy can be saved is thus provided.

It would also be possible to have the switch 41 switched automatically by activating the activating button 40 in such a way that the heating resistance 16 is only connected in the upper power range, i.e. when the power control instrument 36 has controlled the internal heating resistance to from 15 to 100% power. Control is continued as a result of a kink in the corresponding control curve of the power control instrument 36 once the heating resistance 16 has been connected in the case of the corresponding power value. It is however also possible to design the circuit in such a way that the heating body 15 remains entirely connected in the higher power range and the energy controller merely controls the heating resistance 16. However, in each case, the advantage is achieved that only the internal heating resistance is effective at low power. This promotes saving in energy, in particular because, at the very moment when only small power is necessary, i.e. small amounts of food are to be heated, cooking vessels which are small and which do not cover the entire cooker unit are frequently selected. Moreover, particularly in the lower power range which is difficult to start up, the power control instrument controls only the power of the heating resistance 15 and thus receives higher relative switching times than would correspond to the respective portion of the total power of the cooker plate.

The use of two heating resistances 15, 16 in the case of a normal or large plate diameter also has the advantage that only the central heating resistance 15 need be provided for small plate diameters. A reduction in the number of types of heating resistances with corresponding advantages for production and storage can be achieved in this way.

I claim:

1. A self-cleaning cooking apparatus, comprising:

a substantially flat, thin-walled heat reflective plate provided with grooves and forming a closed surface;

a plurality of longitudinally spaced support projections disposed in the grooves;

flattened tubular heating bodies, having at least one upper and lower heat radiating surface, permanently attached to the plate by a sealed connection therethrough, but otherwise arranged to only rest on the support projections in the grooves and forming a cooking surface for receiving a cooking vessel, all contacts made between the support projections of the plate and the heating bodies effectively forming only point contacts which minimize heat flow from the heating bodies to the plate; and, the grooves, heating bodies and point contacts defining free air spaces therebetween open to a substantial extent to both lateral sides of the heating bodies, the upper surface of the heating bodies heating the cooking vessel directly and the lower surface of the heating bodies heating the cooking vessel indirectly, the heat therefrom being radiated downwardly and reflected upwardly by the reflective grooves through the free spaces, the heat supply to the cooking vessel not exceeding normal cooking temperatures, whereby spilled food entering the free air spaces interrupts the heat reflection due to subsequent cooking at the normal cooking temperatures, automatically raising the temperature in the groove high enough to ash the spilled food, the ash being easily removable therefrom, not withstanding the permanently attached heating bodies, which rest on the support projections in the grooves.

2. An apparatus according to claim 1, wherein the support projections are formed by stampings at the bottom of the grooves.

3. An apparatus according to claim 1, wherein the tubular heating bodies are soldered to the plate where they pass therethrough.

4. An apparatus according to claim 1, wherein the grooves and tubular heating bodies are spiral in shape, the grooves imparting to the plate a radial elasticity for receiving absorbing thermal stresses.

5. An apparatus according to claim 1, wherein the tubular heating bodies project only slightly over the upper plane of the plate.

6. An apparatus according to claim 1, wherein the plate is incorporated with its upper plane substantially flush in a cooker plate.

7. An apparatus according to claim 6, wherein the cooker plate has a flat, dish-shaped, substantially uninterrupted trough which is covered by the thin-walled plate.

8. An apparatus according to claim 7, wherein the thin-walled plate has an edge region which lies on an encircling shoulder of the said cooker plate in the region of the trough.

9. An apparatus according to claim 6, wherein the thin-walled plate is fixed on the cooker plate by connecting means which comprise a central bolt.

10. An apparatus according to claim 1, wherein the thin-walled plate has an unheated edge region surrounding the region occupied by the tubular heating bodies.

11. An apparatus according to claim 1, wherein the cooking surface is formed from a plurality of individually connectable heating resistances arranged concentrically, a central tubular heating body being capable of being switched on alone.

12. An apparatus according to claim 1, further comprising a support structure for supporting the thin-walled plate.

13. An apparatus according to claim 12, wherein the support structure is formed by a dish-shaped disc.

14. An apparatus according to claim 13, wherein the thin-walled plate is received in an annular recess of the disc.

15. An apparatus according to claim 13, wherein a central bolt for securing the thin-walled plate to a cooker plate engages in the central region of the disc.

16. An apparatus according to claim 13, wherein the disc has a surface which reflects heat radiation.

17. An apparatus according to claim 13, wherein the disc is joined to the thin-walled plate by beading on the edge of the thin-walled plate.

18. An apparatus according to claim 13, wherein the thin-walled plate is supported by substantially radially running support projections in the disc.

19. An apparatus according to claim 18, wherein the support projections are formed by bends of the disc.

20. An apparatus according to claim 13, wherein heat insulation is provided on at least one side of the disc.

21. An apparatus according to claim 13, wherein the thin-walled plate, the disc and tubular heating bodies together form a connectable unit.

22. An apparatus according to claim 1, comprising a temperature limiter arranged beneath the thin-walled plate.

23. An apparatus according to claim 22, wherein the temperature limiter is arranged in an edge region of the plate.

24. An apparatus according to claim 1, wherein the tubular heating bodies are flexible and have external dimensions of the order of magnitude of 5 mm or less.

25. An apparatus according to claim 1, further comprising heat insulating material disposed below the thin-wall plate, increasing heat reflective and radiating characteristics of the plate, thereby facilitating baking said spilled food into said ash.

* * * * *